US005796326A

United States Patent [19]

Benito

[11] Patent Number: 5,796,326

[45] Date of Patent: Aug. 18, 1998

[54] FUSE ASSEMBLY WITH A ROTATABLE CARRIER FOR HOLDING A PLURALITY OF FUSES

[76] Inventor: Derick V.J. Benito, 4 Voegelsang Road, Bonnie Doon, East London, Cape Province, South Africa

[21] Appl. No.: 630,038

[22] Filed: Apr. 2, 1996

[30] Foreign Application Priority Data

Apr. 2, 1995 [ZA] South Africa ..... 95/1764

[51] Int. Cl.[6] ..... H01H 71/10

[52] U.S. Cl. ..... 337/169; 337/149; 337/171

[58] Field of Search ..... 337/149, 159, 337/161, 163–175

[56] References Cited

U.S. PATENT DOCUMENTS 4,011,537 3/1977 Jackson, Jr. et al. ..... 337/171
4,382,209 5/1983 Loucaides ..... 317/65

*Primary Examiner*—Leo P. Picard
*Assistant Examiner*—Jayprakash N. Gandhi
*Attorney, Agent, or Firm*—Darby & Darby

[57] ABSTRACT

A fuse holder which has a plurality of fuses to be automatically and sequentially connected into an electrical network on failure of an operatively positioned fuse so that transient current surges can be prevented from damaging equipment in the network and from unnecessarily closing down the network for manual repair, the fuse holder having a carrier biased for relative rotation with respect to contacts in the network and fuses with latching contact mechanisms releasable on rupture of the fuse to permit rotation of the carrier.

7 Claims, 3 Drawing Sheets

FUSE ASSEMBLY WITH A ROTATABLE CARRIER FOR HOLDING A PLURALITY OF FUSES

FIELD OF THE INVENTION

This invention relates to a fuse holder which will enable electrical supplies to be restored in the event of power failure due to temporary overloading of the electrical installations.

BACKGROUND TO THE INVENTION

Fuses are used extensively in high voltage electrical networks such as 11–12 KV systems. The fuses are installed to protect the electrical equipment in the network against damage caused by a temporary surge of power through the system for any reason. Blowing of these fuses results in disconnection of the power supply until the fuse is replaced.

They are placed in an electrical circuit as a deliberate weak point such that when a fault occurs, the current will exceed the fuse's rated value, causing it to blow. This breaks the electrical circuit and prevents extensive damage to the equipment within the circuit.

The disadvantage of using the single cartridge fuse is that it cannot distinguish between a temporary fault and a permanent fault. It will blow for every fault. It has then to be manually replaced by an electrician which is a costly exercise.

The well known single cartridge fuse usually consists of a single fibre tube which contains the fuse element. Situated at the base of the fuse tube is the spring loaded drop out mechanism and at the top of the fuse tube is a screw-on contact.

In the event of a fault, the current exceeds the rated value of the fuse element causing it to blow.

The spring loaded drop out mechanism rapidly withdraws the fuse element from the fuse tube thus breaking electrical circuit and allows a temporary fault to clear.

The tension created in the fuse element in the assembly of the drop out mechanism is now released and the unit drops out and hangs freely in the drop out post. This isolates and identifies the faulty section of line.

OBJECT OF THE INVENTION

It is the object of the present invention to provide a fuse assembly which will enable a power supply to be automatically restored after a fuse has blown due to a temporary fault and thus reduce call out costs.

SUMMARY OF THE INVENTION

According to this invention there is provided a fuse assembly comprising a fuse carrier biased for relative rotation with respect to contacts to be connected in an electrical supply, the carrier having a plurality of fuses each including a biased contact latching mechanism at one end, held in the operative position by the fuse element and their other ends arranged for direct connection into the electrical supply.

A further feature of this invention provides for the fuse assembly to fit existing fuse holders providing the contacts for its fuses.

The invention also provides for the carrier to be stationary and to support a spring loaded rotatable contact located to engage the fuse biased contact latching mechanism and for one fuse to be provided with a fuse holder automatic release mechanism.

Alternatively, the invention also provides for the fuses to be located on rotatable arms extending radially from a hub carried by at least one member adapted for location, in use, in a fuse holder in the power supply.

Still further features provide for the latching contacts to be located between anti-flash plates carried on a rotatable shaft mounted within the carrier and biased to rotate the fuses with respect to the carrier and its contacts.

BRIEF DESCRIPTION OF THE DRAWINGS

These and other features of this invention will be described below with reference to the accompanying drawings of alternative embodiments of the invention.

These embodiments are not to be considered as limiting the scope of the invention.

In the drawings:

FIG. 1 is an elevation of one form of the fuse assembly in position in use;

FIG. 2 is a diagrammatic plan of the assembly; and

FIGS. 3 & 4 are details;

FIG. 5 illustrates a different rotating contact assembly; and

FIGS. 6 to 9 a different embodiment of the invention.

DETAILED DESCRIPTION OF THE INVENTION WITH REFERENCE TO THE DRAWINGS

Referring to FIGS. 1 to 4 the fuse assembly (1) consists of a fuse carrier (2) in which are mounted three fuses (3), (4) and (5). Each fuse is held in an insulating tube (6) of highly insulating material such as cycloelemphatic resin.

Figure 1:
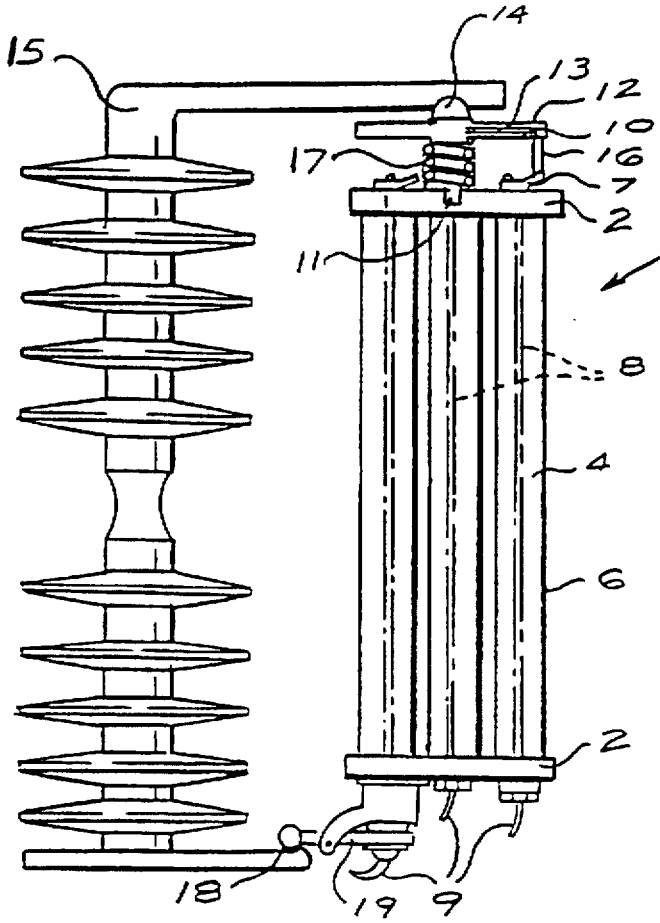
Figure 2:
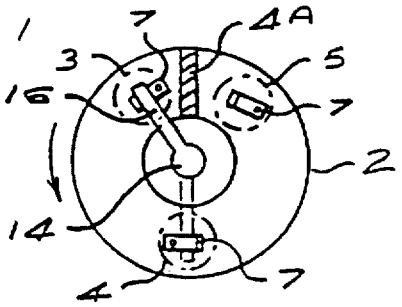
Figure 3:
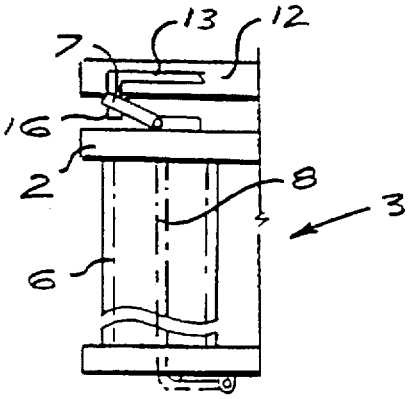
Figure 4:
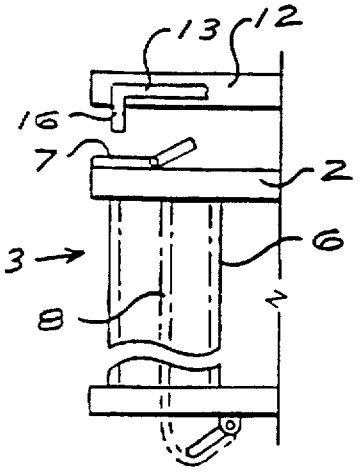

As can be seen from FIG. 2, the tubes are not equally spaced apart but fuses (3) and (5) are adjacent each other and insulated by a resin strip (4A) which is equidistantly spaced between fuses (3) and (5). This serves to create greater electrical clearance between fuses (3) and (4) and fuses (4) and (5).

Each fuse has a tiltable latching contact (7) at its upper end and is held in the operatively position by a fuse element (8) which is normally retained under tension by a suitable spring loaded straining assembly (9) located at the end of the tube opposite the latching contact (7). Should the fuse element (8) rupture due to current overload the straining assembly (9) will rapidly withdraw the fuse from the tube to break the high voltage fault current and the latching contact will tilt into the inoperable position shown for fuse (3) in FIG. 4. This tilting movement may be caused by the contact (7) being shaped and weighted to tilt under gravity or a resilient bias may be provided. Alternatively the spring loading of the rotating contact referred to below can be utilised to cause tilting of the latching contact (7).

The fuse carrier (2) has a rotating contact assembly (10) mounted above the tiltable latching contacts (7). A central rod (11) which may be secured by screw threads projects from the carrier (2) and rotatably supports an anti-flash plate (12) of insulating material in which is embedded a conducting member (13). This conducting member (13) is connected to a central outwardly projecting fixed contact (14) which is adapted to fit into the known form of drop out post (15).

The other end of the member (13) is connected to the rotating contact (16) and the plate is biased to rotate under the influence of a coil spring (17). In this way the rotating contact (16) is held against the latching contact (7) of fuse (3) by the spring loading in the initial setting of the assembly (1) and is retained in position by the spring bias.

Should fuse (3) blow, the straining assembly (9) for fuse (3) will rapidly withdraw the fuse element and the tiltable contact (7) will move free of the rotating contact (16) which will then be driven by the coil spring (17) to move into contact with the latching contact (7) of fuse (4) thus restoring electrical supply. If fuse (4) blows due to another fault the straining assembly (9) for fuse (4) will rapidly withdraw the fuse element, the rotating contact (16) will then move into contact with latching contact (7) of fuse (5), once again restoring electrical supply.

Thus three separate fuses are provided and each of the two not in operation in the original setting of the assembly will automatically be brought into operation to restore the electrical power connected through the fuse in the event of the operatively connected fuse blowing.

The ends of the fuses (3), (4) and (5) opposite the latching contacts are electrically connected together and to a second contact provided in the drop out post assembly which is in turn connected into the power supply. This is preferably done through the bottom contact (18) of the drop out post (15).

To render the drop out mechanism (19) effective, the fuse (5) has its lower end extended below the carrier (2) and is arranged such that the tension applied to the fuse element (8) not only acts on the latching contact (7), but also on the drop out mechanism (19) of the drop out post (15). This latter arrangement is the same as that in the known single fuse drop out post assemblies. The fuse assembly (1) will, when the last fuse has blown, thus releasing the holding in tension, drop out of the drop out post assembly and hang from the lower contact where it isolates and readily identifies the faulty section of the electrical network. The use of a plurality of separate fuses in a single assembly as described above, avoids unnecessary delays in reconnection of the power supply after a single disruptive temporary current surge and the expense of having to reconnect the power supply manually. In the event of a more serious fault the fuses will blow sequentially until the assembly drops out of the circuit.

It will be appreciated that the fuse (5) need not include a latching contact (7) since no further rotation of the rotating contact (16) is required after the last fuse has blown.

Figure 5:
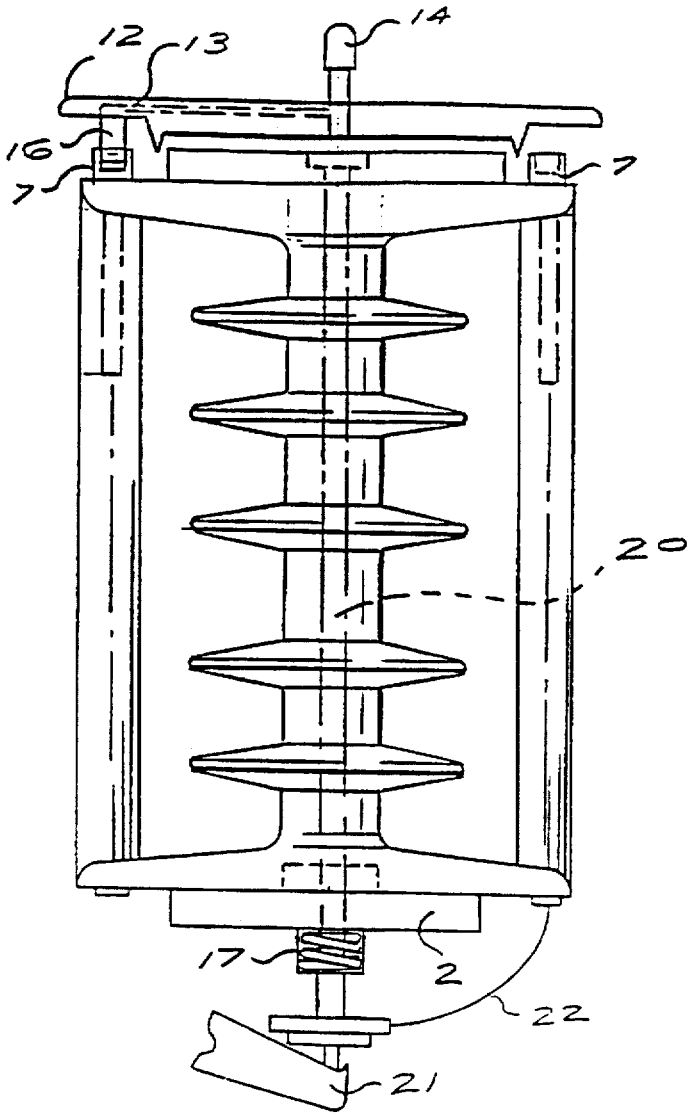
Figure 6:
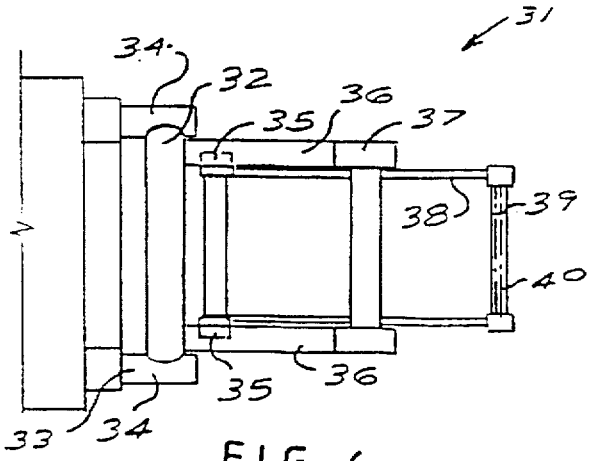
Figure 7:
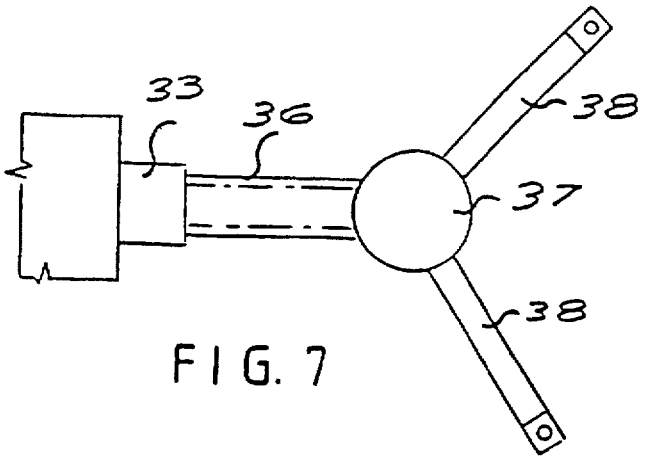

FIG. 5 shows a variation to the assembly described above. In this embodiment the rotating contact (16) and anti-flash plate (12) are carried on an insulating rod (20) which extends from the bottom of the stationary carrier (2). The coil spring is mounted at the bottom of the carrier (2) and the drop out mechanism (21) is held in the operative position by the tension established in the fuse element (22) of the last fuse in the sequence.

FIGS. 6 to 9 illustrate diagrammatically yet a further embodiment of this invention.

As illustrated, a fuse carrier (31) consists of an upright member (32) of insulating material which is, in use, engaged in a fuse holder (33) in an electrical installation.

The member (32) provides electrical connections between the fuse holder contacts (34) and the contacts (35) mounted on insulating members (36) projecting from the top and bottom of the upright member (32).

The members (36) support between them a hub (37) having three symmetrically disposed pairs of radial arms (38). Each pair of arms (38) supports between their free ends a fuse (39).

The hub is spring loaded to rotate about its axis to hold the contacts of a fuse (39) against the contacts (35) provided on the member (36).

Figure 8:
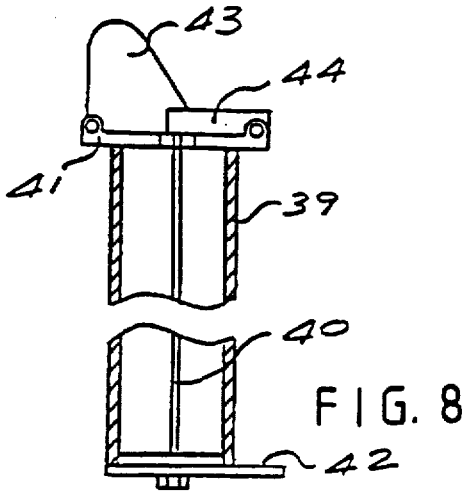
Figure 9:
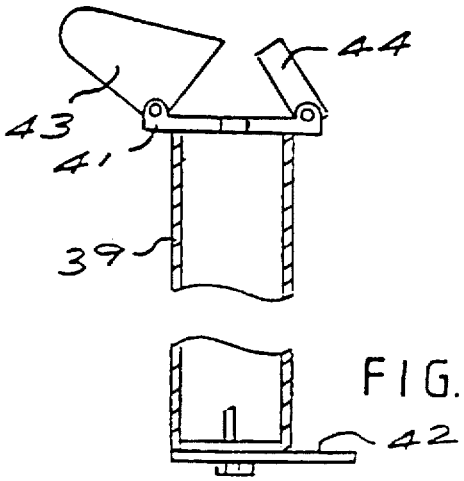

Referring to FIGS. 8 and 9, each fuse (39) in the carrier has a fuse member (40) extending between contacts (41) and (42) and the fuse may be located in a fibre tube. At least the upper contact (41) has a contact plate (43) and latching member (44). The plate (43) and latching member (44) can move relative to each other on pressure applied to the plate when the latching member (44) is released.

The latching member is retained in the operative position by the existence of the fuse member (40).

Should the member (40) be broken the member (44) will allow the contact plate (43) to move out of engagement with the contacts (35) under the influence of the spring pressure of the spring loaded hub (37).

With the release of the plate (44) from contact (35), the hub can rotate until the next fuse is brought into engagement with contacts (35) when the electrical connections will be restored.

Thus, in use, if fuse (39) blows through a temporary surge through the installation another fuse will automatically be brought into operation and connection restored.

In this embodiment also the fuse assembly can be made to include the automatic drop out characteristic with drop out being effected after blowing of the last fuse in the assembly.

The invention can be varied from the embodiments described above and provides a means whereby a single surge of power will not permanently disrupt operation of the electrical installation until a fuse is manually replaced. Different operating mechanisms to release blown fuses may be used and other modifications made by those skilled in the art without departing from the scope of this invention. Further provision may be made for damping the rotational movement if this is considered necessary or desirable.

What I claim as new and desire to secure by Letters Patent is:

1. A fuse assembly comprising a fuse carrier biased for relative rotation with respect to contacts to be connected in an electrical supply, said carrier comprising a plurality of fuses, each said fuse having first and second ends and comprising a fuse element and a biased contact latching mechanism, wherein said contact latching mechanism is at said first end and is held in an operative position by said fuse element and said second end of said fuse is arranged for direct connection into the electrical supply.

2. A fuse assembly as claimed in claim 1, wherein said carrier supports a spring loaded rotatable contact comprising a first contact end for connection into the electrical supply and a second contact end positioned to sequentially engage said biased contact latching mechanisms.

3. A fuse assembly as claimed in claim 2, wherein said carrier comprises means for mounting the assembly in a drop out post.

4. A fuse assembly as claimed in claim 3, wherein one of said fuses further comprises an automatic drop out release mechanism.

5. A fuse assembly as claimed in claim 3, wherein said rotatable contact is mounted on an insulated spring-loaded rotatable shaft comprising means to operate an automatic drop out mechanism.

6. A fuse assembly as claimed in claim 2, wherein said contact latching mechanisms are held tilted against a bias into a position for contact with said rotatable contact by a fuse element.

7. A fuse assembly as claimed in claim 1, wherein said fuses are located on rotatable arms extending radially from a hub carried by at least one member adapted for location during use in a fuse holder in the power supply and providing contacts for sequential engagement with the separate fuse contacts.

* * * * *